United States Patent [19]

Belaire

[11] 4,057,962

[45] Nov. 15, 1977

[54] DEVICE FOR DECREASING THE START-UP TIME FOR STIRLING ENGINES

[75] Inventor: Richard C. Belaire, Livonia, Mich.

[73] Assignee: Ford Motor Company, Dearborn, Mich.

[21] Appl. No.: 748,264

[22] Filed: Dec. 6, 1976

[51] Int. Cl.[2] ..... F02G 1/04

[52] U.S. Cl. ..... 60/526; 60/517; 60/523; 60/525

[58] Field of Search ..... 60/656, 517, 523, 524, 60/525, 526

[56] References Cited

U.S. PATENT DOCUMENTS

| | | | |
|---|---|---|---|
| 3,845,624 | 11/1974 | Roos | 60/524 |
| 4,026,114 | 5/1977 | Belaire | 60/525 |

*Primary Examiner*—Allen M. Ostrager
*Attorney, Agent, or Firm*—Joseph W. Malleck; Keith L. Zerschling

[57] ABSTRACT

The closed fluid working system of a Stirling cycle engine is disclosed having incorporated therein an improved regenerator assembly which modifies the thermodynamic responsiveness of the working system particularly during cold-start conditions. A foraminous regenerator matrix is constructed with a predetermined matrix heat capacity to void volume ratio, and has invested therein an electrical heating element arranged in thermally conductive relationship with a desired zone of the matrix. The heating element is controlled to be energized for attaining precise heat exchange conditions within the matrix.

4 Claims, 2 Drawing Figures

DEVICE FOR DECREASING THE START-UP TIME FOR STIRLING ENGINES

BACKGROUND OF THE INVENTION

A Stirling cycle engine depends very importantly on the operation of a thermal regenerator disposed between the expansion and compression spaces of the closed working fluid system. Although regeneration has been studied for quite a period of time in connection with the operation of the Stirling engine, its true theoretical basis of operation is not completely understood. However, the regenerator is designed with certain practical operating conditions in mind. The design of such regenerator assumes that the temperatures of the working fluid at the inlet to the regenerator matrix will be at a certain minimum temperature level, such as 80° C. The design further assumes that even though the inlet temperature to the matrix will cyclically vary because the compression-expansion of the heat input is other than isothermal, the assumption is that such variation will be relatively, small within the range of ±30° C. Similarly, the temperature at the exit of the matrix, varying as a practical matter because of inlet variance and because limited coefficients of heat transfer, it is assumed will not vary considerably and will be within the limits of, for example, 750 ± 50° C. With these temperature conditions in mind, the designer then selects a certain desirable heat capacity for the regenerator at a certain void volume so as to provide a compromise between tolerable fluid friction therethrough, loss in pressure and optimum heat transfer characteristics.

The resultant regenerator, as designed with these considerations in mind by the prior art, does not compensate for the cold working condition from which a Stirling engine must be started. If a significant goal of the Stirling engine is to be realized, which includes dramatic fuel savings over that of prior art engines, the fuel consumed in raising the temperature of the working fluid from a cold starting condition must be reduced.

Adding additional heat to the expansion space to decrease the amount of time that it takes to raise the working fluid medium to a proper operating temperature is not an adequate solution by itself. This is in part due to the fact that the blow time which is defined to be the net time for flow through the dead space of the system between expansion and compression spaces, including the void volume within the regenerator, is extremely short when compared to other prior art engines, such as a gas turbine engine. For example, at moderate engine speeds of 1200 revolutions per minute, the blow time is 10 times less than that of the permissable mimimum in the gas turbine. In fact, in an engine, which is of moderate size adaptable for vehicular use as a prime mover, the blow time will be so short that many particles of working fluid will never pass completely through the matrix of the regenerator before the flow direction is reversed. The very short net flow time through the matrix in one direction is slightly less than half the complete cycle time. Accordingly, the conventional heat transfer process which occurs through the regenerator is very complex and incomplete, involving repetitive fluid-to-matrix, matrix-to-fluid, fluid-to-matrix cycle relationships.

What is needed is a mechanism or method by which the working fluid of a Stirling cycle engine can be moved rapidly from a cold starting state to an operating temperature condition without reliance upon the normal external circuit or the normal transfer of heat from the external heating circuit through the conventional compression-expansion cycle. If the latter were to be the only alternative solution, it would be hindered by fluid friction within the working cycle and the need for a larger void volume within the regenerator to speed up the temperature increase of the matrix. All of this would work at odds with the desire for efficient operation at high temperature conditions.

SUMMARY OF THE INVENTION

A primary object of this invention is to provide an improved Stirling cycle engine having more responsive thermodynamic characteristics with greater efficiency and less fuel consumption.

Another object of this invention is to provide a regenerator system between the expansion and compression spaces of the closed working system of said engine which results in a decreased blow-in and blow-out time for regenerator use in said system, particularly during the start-up condition of said engine.

Yet still another object of this invention is to provide a regenerator system for a closed working cycle system of a Stirling engine which is maintained as a small matrix with minimum void volume and fluid friction characteristics and which has an integral supplementary heating means located within the matrix to employ the high thermal conductivity of said matrix for transferring heat to said closed cycling gas independently of said external combustion circuit.

Features pursuant to the above objects comprise the (a) construction of a regenerator by use of a random packing of short lengths of metallic wire, or by use of wire screens aligned to form a stable semi-rigid block, or forming the regenerator as a very thin space annulus; (b) in any of the above constructions, electrical heating wire, encased in an insulated sheath, is embedded in the central zone or space of the regenerator; (c) the heating wire is connected to a suitable source of energy and is selectively energized in accordance with start-up operation and de-energized in accordance with the attainment of required temperature levels within the regenerator matrix.

DETAILED DESCRIPTION

Figure 1:
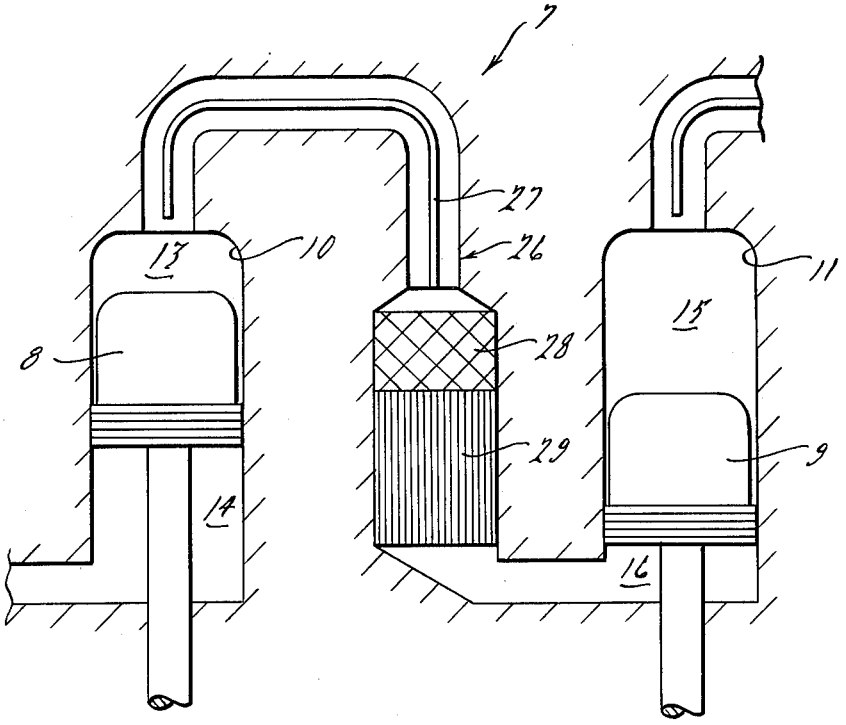
FIG. 1 is a schematic illustration of a portion of a working fluid system of a Stirling cycle engine characteristic of the prior art.
Figure 2:
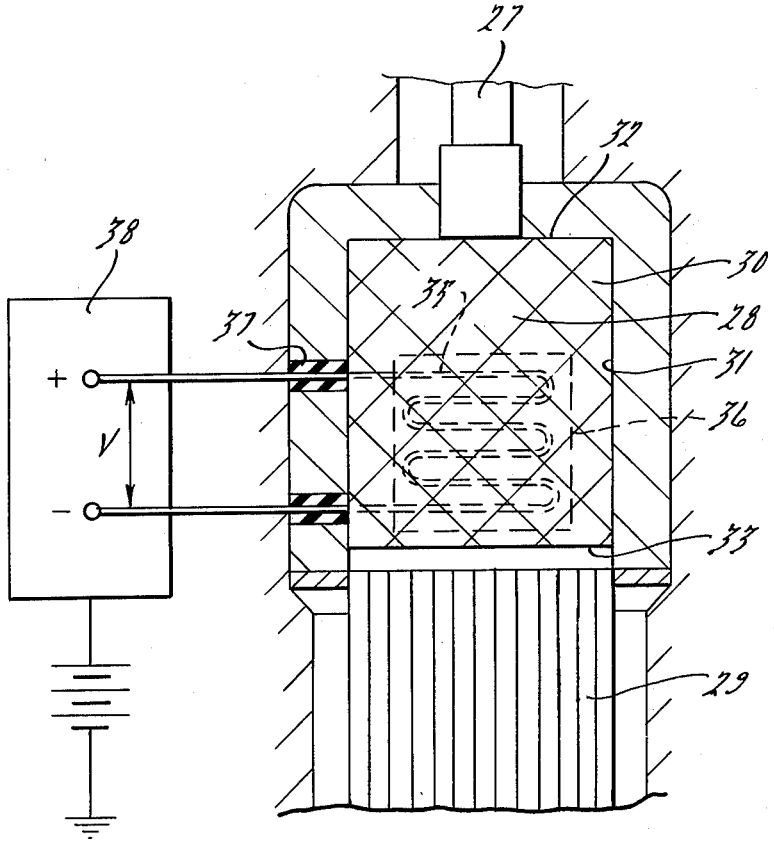
FIG. 2 is an enlarged fragmentary view of a portion of the regenerator-cooling apparatus of the system of FIG. 1.

Turning to FIG. 1, there is illustrated a portion of the closed working fluid system 7 of the Stirling-type engine having the pistons arranged in a double-acting manner. A plurality of cylinders, two of which are shown here as 10 and 11, have the volume therein each respectively subdivided by pistons or reciprocating heads 8 and 9 so that each cylinder will have the variable volume therein comprised of a high temperature (hot) space and a low temperature (cold) space. The hot space acts as an expansion volume and the cold space acts as a compression volume. For example, with respect to cylinder 10, the hot space is identified as 13 and the low temperature space as 14; with respect to cylinder 11, the hot space is identified as 15 and the low temperature space as 16. Each hot space of one cylinder is connected by a suitable communicating means 26 to a low temperature space 16 of the next most adjacent cylinder. Such communicating means comprises a gas passage 27 in which is interposed a regenerator 28 and a cooling apparatus 29, each functioning in a typical manner in the Stirling cycle engine, whereby gas is being displaced from the hot chamber 13 and conveyed through passage 27 allowing the heat content thereof to be absorbed by the regenerator 28 and to be further cooled by mechanism 29 before entering the low temperature space 16. Such gases are again displaced during another phase of the Stirling cycle, from the low temperature space 16 back through the passage 27, absorbing heat units from the regenerator 28 and again re-entering hot chamber 13.

In practical application, all gas units may not actually undergo a complete translation from the hot to the cold chambers but rather there is thermal conductivity that takes place through some of the gas medium that is directed along such path.

The control and operation of a double-acting hot gas type of engine is more typically described in U.S. Pat. No. 3,859,972 which demonstrates a control whereby a change in the mean cycle working pressure will increase or decrease engine speed and torque. Pistons 8 and 9 are mechanically linked with respect to each other in accordance with the desired timing for variance in the respective space volumes such that piston 8 also extracts work energy during the upstroke for contraction of space 13. When both sides of the same piston are utilized for the purposes of serving two separate thermodynamic cycles, the pressures on opposite sides should be phased to permit the pistons to operate properly.

The regenerator matrix absorbs heat units from a high temperature medium and releases said heat units to a low temperature medium. A typical material useful for such matrix comprises a stainless steel wire 30 entrained within a stainless container 31 and inserted in heat conductive relationship with the flow passages. Wire diameter is controlled and may be as small as 0.001 inch. Non-metallic regenerator matrices, such as those composed of ceramic material, can also be considered for application of this concept.

The most typical configuration for such regenerator matrix is a block having one end 32 adapted to act as an inlet for hot gases exposed thereto and an opposite end 33 adapted to act as an exit and as a communication with the cooling apparatus 29. The porosity or void volume within said matrix is designed to provide a proper gas flow communication during the working cycles of said engine. The void volume should be such to minimize friction losses and maximize heat transfer between the matrix and the working gas.

Alternatively, the regenerator can be comprised of a series of woven wire screens sintered together to form a stable semi-rigid block. One mode of manufacture is to pack the screens in a desired form and load the form with a weight. The wire screens are then cleansed by nitric or hydrochloric acid; the loaded assembly is heated for a short period in a furnace with a reducing atmoshpere. Upon removal it will be found that the screens will be sintered into a solid assembly that can be lightly machined. It is important to arrange the screens or the wires normal to the axis of flow communication.

In all of these constructions of the regenerator, an independently energized heating element 35 is invested within said matrix and located particularly within the central zone 36 of said matrix. The heating element 35 may be comprised of common electrical wire; it is electrically insulated by sheathing 37 of to maintain separation between the metallic elements or container 31 of said regenerator and the electrical conductive material of the heating element 35.

A control 38 for said heating element is comprised of a device by which the matrix temperature can be sensed such that when a preset bulk temperature level is reached, the auxiliary heating can be switched off and the engine continued or restarted in the normal fashion; said control, of course, energizing said heating element upon closing of the starting circuit of the engine.

A method by which said matrix can be invested with the heating element is as follows:

a. In the case of a regenerator fabricated from loose cut wire pieces, the heating element can be implanted in the container 31 before filling with the wire pieces. When the filling is completed the entire mass may be sintered;

b. For a regenerator fabricated from stacked wire screens, the container 31 can be divided into two portions, each filled in a normal manner with the wire screens. The heating element can then be inserted between the two completed portions of the regenerator, and the entire assembly brazed/ sintered together; and c. For a matrix fabricated from a non-metallic or ceramic material, the heating element can be installed in a manner similar to (b) above.

I claim:

1. A closed fluid working circuit for a regenerative type Stirling engine having a conventional electrical circuit and system for starting, the closed fluid working circuit having a plurality of chambers subdivided by double-acting pistons operating therein, the subdivided chambers being respectively hot and cold and connected in series whereby a hot chamber is always in communication with a cold chamber of the next most adjacent cylinder, said intercommunication between adjacent cylinders containing a foraminous regenerator matrix and a cooling mechanism, the improvement comprising:

a. means defining an electrical heating element invested within said regenerator matrix, said element extending throughout a zone of said regenerator matrix to effect raising the temperature of said regenerator matrix to a temperature level substantially above a predetermined mean operating temperature within a predetermined period of time, measured from when said element is energized, and b. control means effective to energize the electrical element upon closing of the starting circuit of said engine and effective to de-energize said element when a predetermined temperature level is reached in a hot chamber.

2. The improvement as in claim 1, in which said matrix is non-conductive and said electrical heating element is comprised of a conductive wire laid in a continuous coil winding extending through the central zone of said matrix, said coil being insulated only with respect to the container of said regenerator matrix.

3. The improvement as in claim 1, in which said matrix is comprised of a random packing of short lengths of ferrous or non-ferrous small diameter wire, said heating element being comprised of a single strand of similar wire intermingled in contact with said short lengths of wire in said central zone.

4. The improvement as in claim 1, in which said matrix comprises metal walls entraining a thin annulus void said heating element being in thermally conductive contact with said metal walls.

* * * * *